United States Patent [19]

Willis

[11] Patent Number: 4,713,938

[45] Date of Patent: Dec. 22, 1987

[54] GAS TURBINE ENGINE GASEOUS FUEL INJECTOR

[75] Inventor: Jeffrey D. Willis, Coventry, United Kingdom

[73] Assignee: Rolls-Royce plc, London, United Kingdom

[21] Appl. No.: 856,987

[22] Filed: Apr. 29, 1986

[30] Foreign Application Priority Data

Jun. 7, 1985 [GB] United Kingdom ..... 8514478

[51] Int. Cl.[4] ..... F02C 1/00

[52] U.S. Cl. ..... 60/742; 60/748

[58] Field of Search ..... 60/742, 748, 734, 737, 60/740

[56] References Cited

U.S. PATENT DOCUMENTS

| | | | |
|---|---|---|---|
| 3,691,765 | 9/1972 | Carlisle | 60/742 |
| 3,713,588 | 1/1973 | Sharpe | 60/742 |
| 4,342,198 | 8/1982 | Willis | 60/742 |
| 4,425,755 | 1/1984 | Hughes | 60/748 |

*Primary Examiner*—Carlton R. Croyle
*Assistant Examiner*—Timothy S. Thorpe
*Attorney, Agent, or Firm*—Cushman, Darby & Cushman

[57] ABSTRACT

A gaseous fuel injector for an industrial gas turbine plant is arranged to operate on fuel produced from a coal gasifier for normal running or natural gas for starting purposes. The injector is self purging to prevent the ingestion of natural gas or combustion products into the passage of the fuel injector for the lower calorific value fuel. The fuel injector has fuel ducts and gas flow passages in a duct assembly attached to the head of each flame tube of a gas generator. For starting, natural gas flows through the duct and the central passage, while air flows through the outer passage preventing ingestion of natural gas and combustion products into the outer fuel duct. When running on fuel from a coal gasifier both ducts run full of fuel, as do the passages. The air for the coal gasifier may be provided by the gas generator.

3 Claims, 4 Drawing Figures

GAS TURBINE ENGINE GASEOUS FUEL INJECTOR

This invention relates to a fuel burner for a gas turbine engine which is adapted for use as an industrial power plant, e.g., to generate electricity.

Engines of this type are frequently based on the gas generators of aero gas turbine engines and can be required to operate on a range of liquid and gaseous fuels. It is desirable that the amount of work required to adapt these engines to operate on a range of fuels be kept to a minimum. The present invention is particularly, but not exclusively concerned with a fuel burner which can operate on gaseous fuels of different calorific value, for example, natural gas which is of a high calorific value, and gas produced from coal which is of a medium calorific value.

Fuel burners which can run on more than one fuel, usually known as dual fuel burners, tend to have separate ducts for the different fuels. A common problem with such an arrangement is to provide a purging flow in one of the ducts, when fuel is flowing through the other duct, in order to prevent recirculation of combustion products into the duct not containing fuel.

Also, depending on the nature of the fuels involved, it can be difficult to start the engine because of low exit velocities air from the engine compressor, and the resulting poor fuel placement in the combustion chamber. For example, gas turbines can operate on gas fuel produced from coal in an oxygen blown gasifier, the gasifier being driven by power from the gas turbine. Clearly, some means of starting the gas turbine on another fuel will be required. That other fuel can be natural gas.

The present invention seeks to provide a gas turbine engine fuel burner which can operate on gas fuels of different calorific values, which is self-purging and which can be readily fitted to an existing engine.

Accordingly the present invention provides a gas turbine engine fuel injector comprising a central gaseous fuel duct, an outer annular gaseous fuel duct in which the central gas fuel duct is located, a central gas flow passage and an outer, annular gas flow passage, both said passages being adapted to receive gaseous fuel from the gaseous fuel ducts, the outer gas flow passage being adapted to receive compressor delivery air from the engine.

The inner and outer gas flow passages can be formed as a duct assembly attached to the upstream end of a combustor can, whilst the central and outer gaseous fuel ducts form part of a fuel injector assembly attached to a casing of the engine, the fuel injector and duct assemblies not being attached to one another.

The duct assembly may comprise an outer ring which supports a circular section central duct by struts or swirl vanes. The central duct can support a pintle by means of struts or swirl vanes, and the pintle in combination with the central duct can define an annular flow passage of a cross-section diminishing in the downstream direction.

The fuel injector assembly can comprise a pair of pipes, one located within the other, terminating at one end with a flanged attachment so that the injector can be secured to the engine casing. The fuel injector terminates at the other end in pair of outlets having a common axis, the said axis being aligned with the axis of the duct assembly. The inner one of the outlets can extend into the central duct of the duct assembly.

The central gaseous fuel duct can be arranged to receive natural gas fuel, whilst the outer gaseous fuel duct runs empty, or the outer gaseous fuel duct can be arranged to receive gaseous fuel of a medium calorific value, e.g., gaseous fuel produce from coal whilst the central gaseous fuel duct runs empty. In the latter case, both of the passages of the duct assembly still run full with gaseous fuel, though the outer passage may contain a small flow of compressor delivery air. In the former case the inner gas flow passage runs full with natural gas and the outer gas flow gassage runs full with compressor delivery air.

The present invention will now be more particularly described with reference to the following drawings in which FIG. 1 shows a general arrangement of a gas turbine engine in which the present invention is incorporated.

Figure 1:
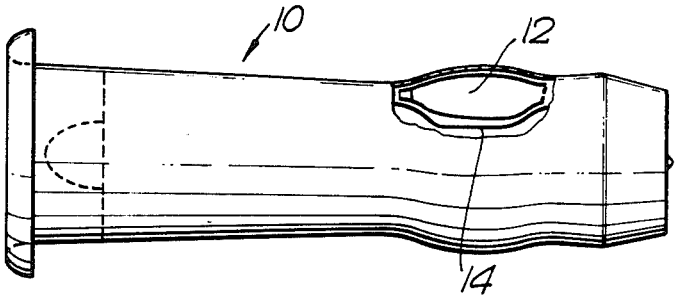
Figure 2:
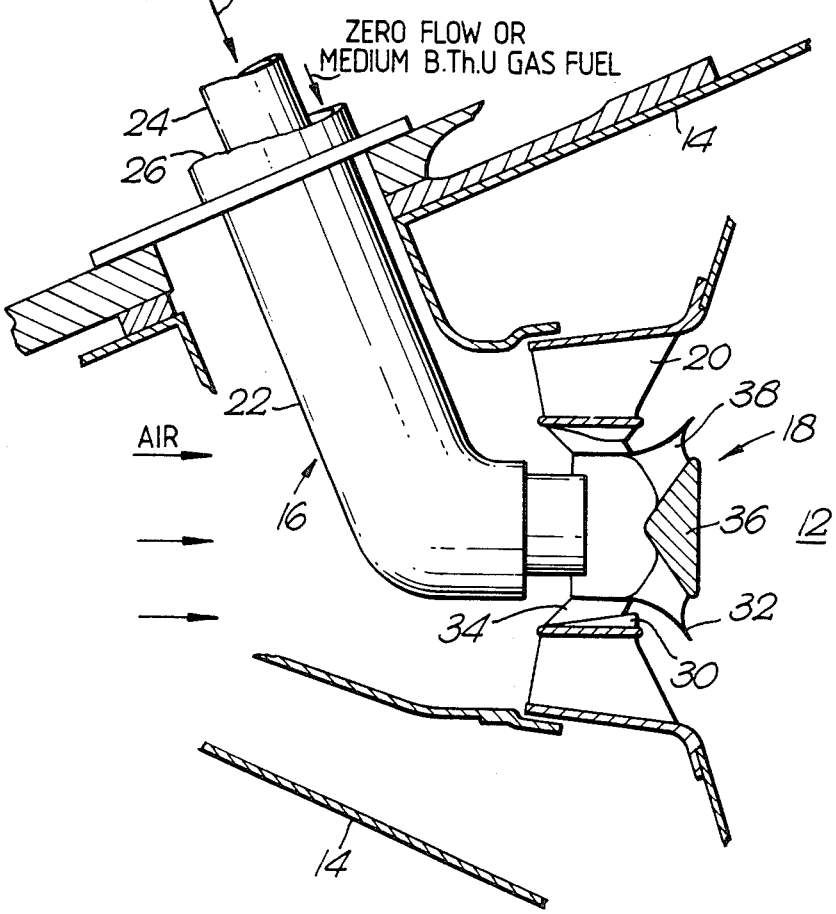
FIG. 2 shows the upstream end of one of the combustor cans of the engine shown in FIG. 1, illustrating one embodiment of the present invention.

Referring to FIG. 1, a gas generator 10 of a gas turbine engine power plant includes a plurality of combustor cans 12 located in an annular housing 14. The housing and each can receive a flow of air from the gas generator compressor (not shown) and a flow of fuel (see FIG. 2), and the products of combustion are used to drive the gas generator compressor driving turbine (not shown). The exhaust gases from the gas generator 10 are used to drive a power turbine (not shown) which turn drives a load, such as an electrical generator.

Each combustor can or flame tube 12 has a fuel injector 16 attached to a casing 18 of the gas generator. The fuel injector 16 co-operates with a duct assembly 18 located within a ring of swirl vanes 20 positioned in the head of each flame tube 12.

Each fuel injector 16 (see also FIGS. 3 and 4) includes a pair of concentric ducts 22, 24 of which the inner duct 24 forms a central gaseous fuel duct, and the space between the inner and outer ducts forms an outer annular gaseous fuel duct 26. The outlets of the gaseous fuel ducts are aligned with the duct assembly 18 secured to the flame tube, and the central fuel duct includes a flow directing vane 28.

Each duct assembly 18 comprises an outer ring 30 which supports a central duct 32 by means of swirl vanes 34, and the central duct in turn supports a pintle 36 by means of swirl vanes 38. The outer ring 30 and the central duct 32 define an outer annular gas flow passage 40, and the central duct 32 and the pintle 36 define an inner annular flow passage 42. Both of the gas flow passages 40, 42 decrease in cross-sectional area in the direction of gas flow through the passages, as indicated in FIGS. 3 and 4.

The gas generator is adapted to operate during normal running conditions on a medium calorific gas produced in a coal gasifier, the air for the gasifier being taken from the compressor of the gas generator, or from a separate compressor driven by the gas generator.

However, it is not easy to start the gas generator on gaseous fuel produced from coal and a conventional fuel, such as natural gas which is of a high calorific value (100 BTU/Sct) is used.

Figure 3:
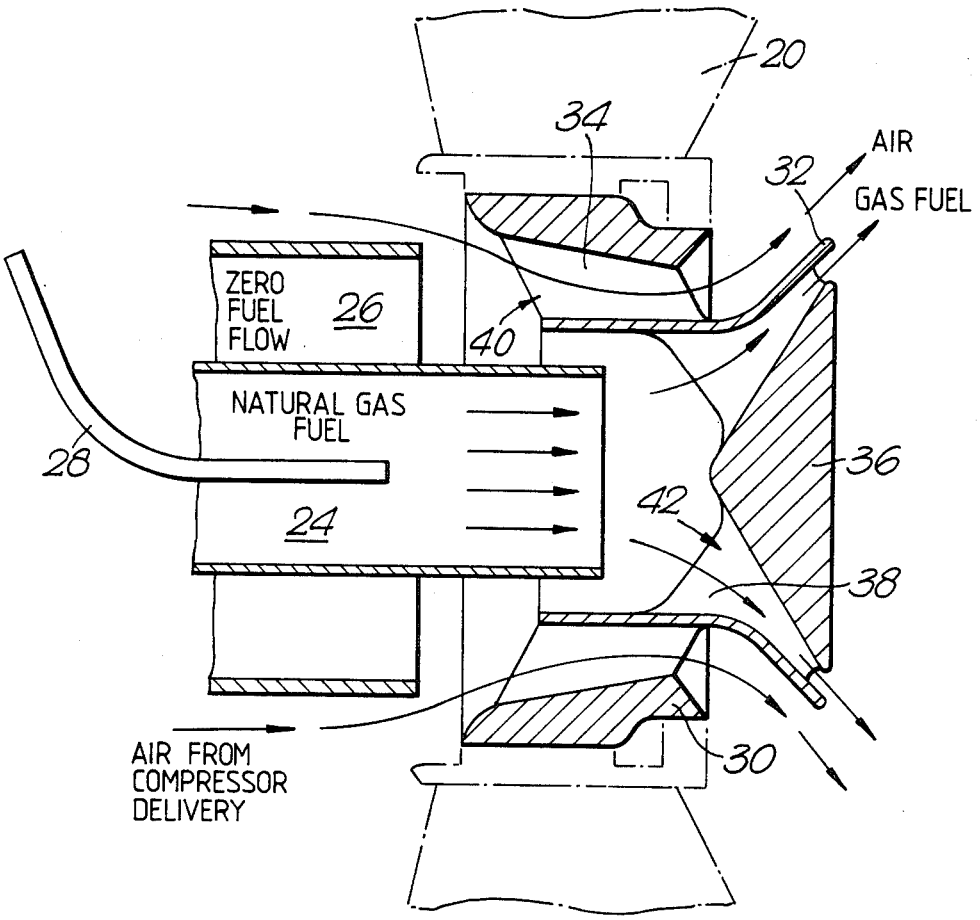
FIG. 3 shows the fuel burner of FIG. 2 when operating on natural gas.
Figure 4:
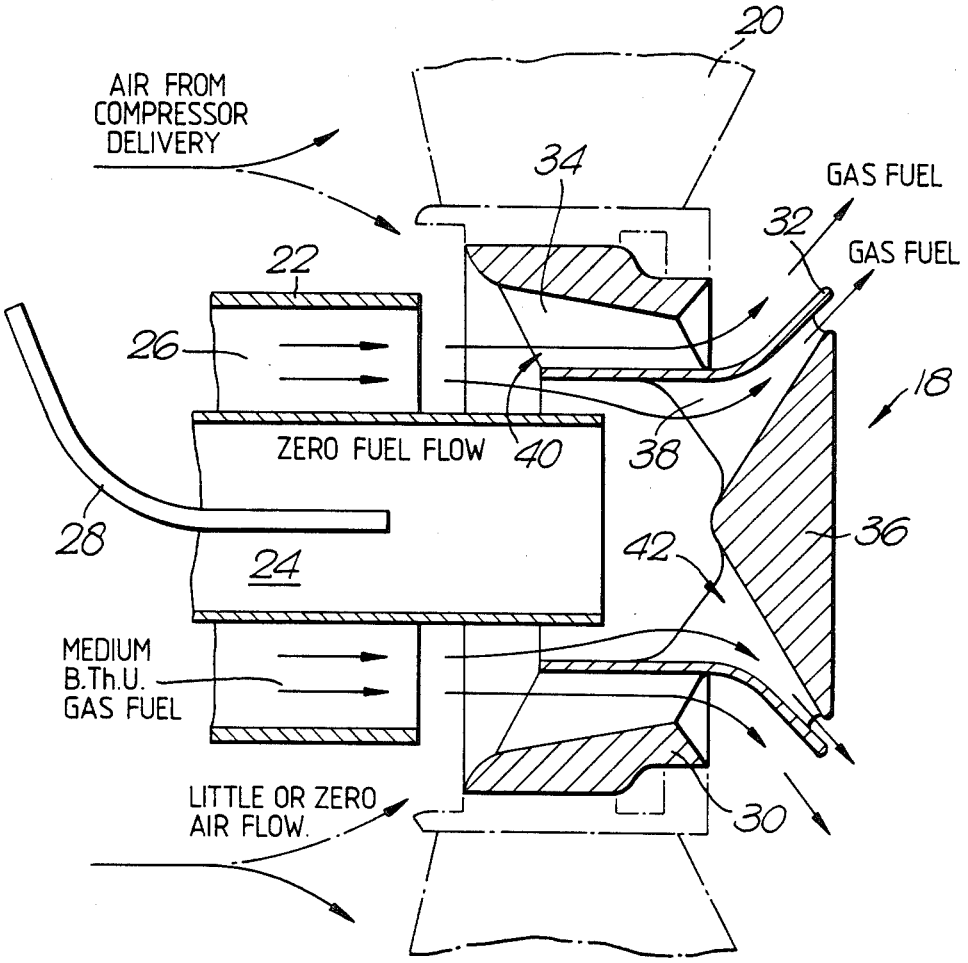
FIG. 4 shows the fuel burner of FIG. 2 when operating on medium calorific value gas fuel.

Referring to FIG. 3 in the starting phase of the gas generator, the outer gaseous fuel duct 26 runs empty of either fuel or air, and the natural gas fuel flows through the central duct. The gas fuel then flows through the inner gas flow passage 42 of the duct assembly 18, where it is accelerated due to the decreasing area of the duct, and swirled by the vanes 38 before entering the flame tube 12. Due to the pressure drop across the flame tube, delivery air from the gas generator compressor flows through the outer gas flow passage 40, and it is this flow of air which prevents the ingestion of natural gas fuel and products of combustion into the outer gaseous fuel passage 26. Once the engine has started, and the coal gasifier is producing sufficient quantities of medium calorific value gas fuel, the supply of natural gas is cut off, and fuel from the coal gasifier is supplied to the outer duct 26 only (FIG. 4). Under these conditions, little or no compressor delivery air flows through the outer gas flow passages 40, but both of the passages 40, 42 run full with gas fuel. The compressor delivery air which flows into the upstream end of each flame tube passes in through the swirl vanes 20.

The arrangement described above provides a means for starting a gas generator which is designed to operate on fuel produced from a coal gasifier powered by the gas generator, and which does not require a separate purging system to prevent the ingestion of fuel and combustion products.

I claim:

1. A gas turbine fuel injector comprising:

an outer gaseous fuel duct having a downstream end;

a central gaseous fuel duct coaxially positioned within said outer fuel duct and having a downstream end projecting therefrom;

said outer gaseous fuel duct and said central gaseous fuel duct comprising a pair of pipes, one located within the other, and having at one end a flange attachment for the securing of the assembly to the engine casing, the injector terminating at the other end in a pair of outlets, each having an axis, means for supplying natural gas fuel to said central gaseous fuel duct and means for supplying gaseous fuel from a coal gasifier to said outer gaseous fuel duct;

an outer ring;

a plurality of swirl vanes extending inwardly from said outer ring;

a central duct member supported from said outer ring by said swirl vanes, said central duct having an upstream end and a downstream end;

a plurality of further swirl vanes extending inwardly from said central duct member;

a pintle supported from said central duct member by said further swirl vanes;

said outer ring, central duct member and pintle defining between them an outer annular flow passage and an inner annular flow passage, said outer annular flow passage and said inner annular flow passage each decreasing in cross-sectional area in a direction of flow therethrough;

said central gaseous fuel duct having the downstream end thereof extending into said central duct member for directing gaseous fuel therefrom into said inner annular flow passage; and said outer gaseous fuel duct having means for spacing said downstream end thereof a distance from said inner and outer flow passages and said upstream end of said central duct member to direct gaseous fuel into both said inner annular flow passage and said outer annular flow passage.

2. A fuel injector as claimed in claim 1 in which the central and outer gas flow passages are part of a duct assembly attached to the upstream end of a flame tube of the engine.

3. A fuel injector as claimed in claim 1 in which the central and outer gaseous fuel ducts are part of a fuel injector assembly attached to a casing of the engine.

* * * * *